US005100347A

United States Patent [19]

Malasky, III et al.

[11] Patent Number: 5,100,347

[45] Date of Patent: Mar. 31, 1992

[54] METHOD AND APPARATUS FOR PROVIDING A CABLE ASSEMBLY SEAL AND STRAIN RELIEF

[75] Inventors: Joseph J. Malasky, III, Fort Lauderdale, Fla.; David A. Smith, Ickesburg, Pa.

[73] Assignee: E. I. du Pont de Nemours and Company, Wilmington, Del.

[21] Appl. No.: 346,876

[22] Filed: May 3, 1989

[51] Int. Cl.[5] ..... H01R 13/504

[52] U.S. Cl. ..... 439/604; 439/936

[58] Field of Search ..... 439/275, 276, 449, 455, 439/523, 587, 604, 636, 936; 264/271.1, 272.11, 255, 272.14, 277

[56] References Cited

U.S. PATENT DOCUMENTS

| | | | |
|---|---|---|---|
| 3,086,251 | 4/1963 | Bernat | 264/277 |
| 3,744,128 | 7/1973 | Fisher et al. | 439/936 X |
| 4,398,785 | 8/1983 | Hedrick | 264/272.11 X |
| 4,461,529 | 7/1984 | Fariss | 439/604 |

FOREIGN PATENT DOCUMENTS

| | | | |
|---|---|---|---|
| 1165120 | 3/1964 | Fed. Rep. of Germany | 264/272.14 |
| 955432 | 4/1964 | United Kingdom | 439/606 |

*Primary Examiner*—Eugene F. Desmond
*Attorney, Agent, or Firm*—John E. Griffiths

[57] ABSTRACT

This invention relates to a method and apparatus for providing a cable assembly seal and strain relief and, in particular, where the apparatus comprises a pre-mold for use with an overmold to provide the seal and strain relief for electrical conductors terminated within an electrical housing.

9 Claims, 2 Drawing Sheets

METHOD AND APPARATUS FOR PROVIDING A CABLE ASSEMBLY SEAL AND STRAIN RELIEF

BACKGROUND OF THE INVENTION

1. Field of the Invention

This invention relates to a method and apparatus for providing a cable assembly seal and strain relief and, in particular, where the apparatus comprises a pre-mold for use with an overmold to provide the seal and strain relief for electrical conductors terminated within an electrical housing.

2. Description of Related Art

Cable assemblies are commonly available having a connector housing containing a plurality of terminals, each of the terminals in a separate passage and connected to one of a plurality of similarly shaped and sized conductors. In such assemblies, it is desirable to seal the passages where the conductors enter the housing. It is also desirable to provide strain relief to reduce twisting or bending of the conductors with respect to the terminals and the housing.

U.S. Pat. No. 3,854,787 discloses the use of flexible flaps to provide strain relief. The flaps are either integral with the housing or connected with a sleeve portion that fits around the connector housing. The flaps are secured together, such as by nuts and bolts, capturing the conductors between the flaps.

U.S. Pat. No. 4,105,278 discloses the use of a mechanism for sealing the points where conductors enter a connector housing. A ribbon shaped cable containing a plurality of conductors having similar shapes and sizes enters the housing through a sealing mechanism. The housing is molded directly to the sealing mechanism under an elevated pressure, such as, by an injection molding process. The pressure from the injected material acts against lips of the sealing mechanism to urge the lips against the cable to impede wicking of the material along the cable beyond the seal.

Another way that seals and strain reliefs have been provided is through an elevated temperature, high pressure injection molding process without the use of lips as disclosed in U.S. Pat. No. 4,105,278. A mold or tooling is created for injection molding a material to encapsulate a specific set of uniformly shaped and sized conductors where they exit a housing. However, such tooling is expensive to make and economically unjustified for making small quantities of such connector assemblies. Further, a different mold is needed for differently shaped and sized conductors. Moreover, injected material does wick out of the mold between cables, especially when the cables vary in shape or size.

It is considered desirable to have a method and apparatus for providing a connector assembly seal and strain relief through an injection molding process that permits the repeated use of tooling for conductors of varying shapes and sizes and eliminates leaking or wicking out of the injected material.

SUMMARY OF THE INVENTION

The present invention relates to a cable assembly for interconnecting electrical circuits comprising:

a connector housing having a first end and a plurality of passages extending out of the first end;

a plurality of conductors having various cross sectional shapes, sizes or types of construction, each of the conductors extending into a different one of the passages through the first housing end;

a premold encapsulating the conductors near the housing; and an overmold connecting the premold to the housing, whereby the premold and the overmold function as a seal and strain relief for anchoring and preventing bending and twisting of the conductors with respect to the housing.

The present invention is further directed to a method for making a strain relief for a cable assembly comprising a connector housing, the housing having a first end and a plurality of passages, and a plurality of conductors having various cross sectional shapes, sizes or types of construction, each of the conductors extending into a different one of the passages through the first housing end, comprising the steps of:

forming a premold in a first mold at a first temperature and a first pressure encapsulating the conductors near the housing; and forming by injection molding an overmold in a second mold at a second temperature and a second pressure connecting the premold to the housing, whereby the premold and the overmold function as a seal and strain relief for anchoring and preventing bending and twisting of the conductors with respect to the housing.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figure 1:
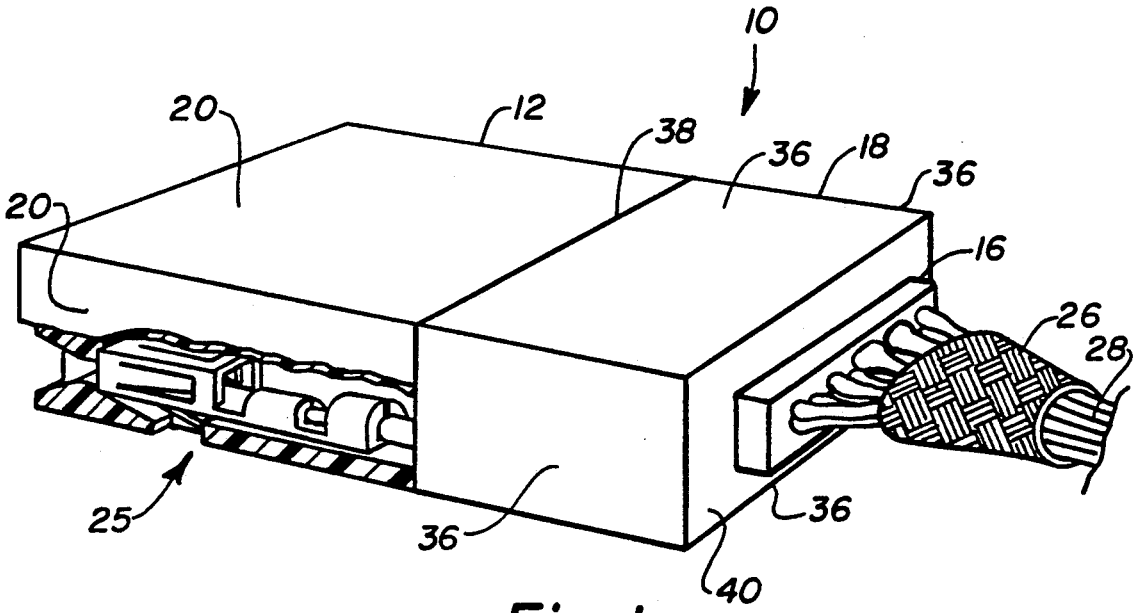
FIG. 1 illustrates a cable assembly seal and strain relief apparatus in accordance with the present invention.

Throughout the following detailed description, similar reference numerals refer to similar elements in all Figures of the drawings.

Figure 2:
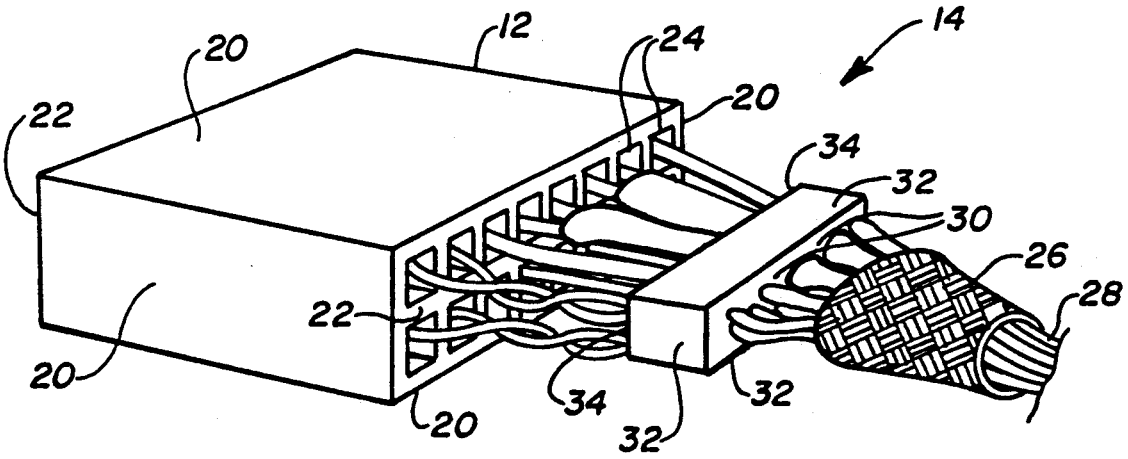
FIG. 2 represents the apparatus of FIG. 1 with the strain relief removed.

Referring to FIGS. 1 and 2, there is illustrated a cable assembly 10 for interconnecting electrical circuits comprising a connector housing 12, a plurality of conductors 14 terminating within the housing 12, a premold 16 encapsulating the conductors 14 near the housing 12 and an overmold 18 connecting the premold 16 to the housing 12. The premold 16 and the overmold 18 function as a seal and strain relief for anchoring and preventing bending and twisting of the conductors 14 with respect to the housing 12.

The connector housing 12 is depicted as having four generally rectangular planar sides 20 and two generally rectangular planar ends 22. The housing 12 has a plurality of generally parallel internal passages 24 which extend from one of the housing ends 22 to the other housing end 22. The passages 24 may be arranged in two rows, although other arrangements are intended to be covered by the scope of the present invention. For example, the housing 12 may be square or cylindrical, thereby allowing or requiring the passages 24 to be arranged in other various configurations to fit within the outer peripheries of the particular housing ends 22.

Each one of the passages 24 contains an electrical contact, terminal or the like 25 which is adapted to be electrically connected to a separate connector or conductor. In practice, one or more of the contacts may intentionally remain unconnected to a conductor 14 in which case its corresponding passage 24 does not receive a conductor 14. In the embodiment shown in FIG. 1, several styles of conductors 14 of varying cross sectional shapes, sizes and/or types of construction are connected to contacts within the passages 24 of the housing 12. The conductors 14 can include virtually any types, such as, tri-leads, coaxes, twisted pairs, discrete wires, twin-axes and heat shrink tubes over braiding. Each of the conductors 14 comprises one or more electrical wire, each wire covered by an insulative layer. Further, each conductor 14 may have a similar or different shape or size. Typically, outside of the housing 12, the plurality of conductors 14 will be bundled together within a braided shield 26 and then a flexible insulative tube 28.

The premold 16 encapsulates the conductors 14 near, but preferably spaced from, the housing 12. The gathering, registration or position of the conductors 14 in the premold 16 can be random or in no particular order. Gaps 30 can exist between the conductors 14 in the premold 16. Encapsulating the conductors 14 in the premold 16 results in a configuration that is uniform and repeatable. The premold 16 is then used as a seal or seal off for the strain relief overmold 18. In the illustrated embodiment, the premold 16 comprises a block having four generally rectangular planar sides 32 and two ends 34. The conductors 14 extend through the premold ends 34. The premold 16 may be made from a material with a low melting temperature at low pressures, such as polyvinyl chloride.

The overmold 18 preferably encapsulates a portion of the premold 16 and the conductors 14 between the housing 12 and the premold 16 such that one of the premold ends 22 extends out of the overmold 18. In the embodiment illustrated, the overmold 18 comprises a block having four generally rectangular planar sides 36, a first end 38 and a second end 40. The first overmold end 38 is connected to a first one of the housing ends 22. The premold 16 partially extends out of the second overmold end 40. Each of the overmold sides 36 may be coplaner with one of the housing sides 20. Alternatively, each of the overmold sides 36 can have a portion immediately adjacent the housing that is coplanar with one of the housing sides 20. In this configuration, the remainder of the overmold sides 36 should be within the space defined by the planes of the housing sides 20. Alternatively, each of the overmold sides 36 can be within or including the space defined by the planes of the housing sides 20. These shapes enable a plurality of the housings 12 to be located in side by side relationship immediately adjacent to one another in a two dimensional matrix pattern. The overmold 18 may be made from a flame retardant material, such as polypropylene.

The present invention is further directed to a method of making the aforedescribed cable assembly 10. Specifically, the method first comprises forming the premold 16 in a first mold 42 at a first temperature and a first pressure encapsulating the conductors 14 near the housing 12. The first temperature and first pressure are low enough to avoid leakage of the encapsulant from the first mold 42 during the formation of the premold 16.

Figure 3:
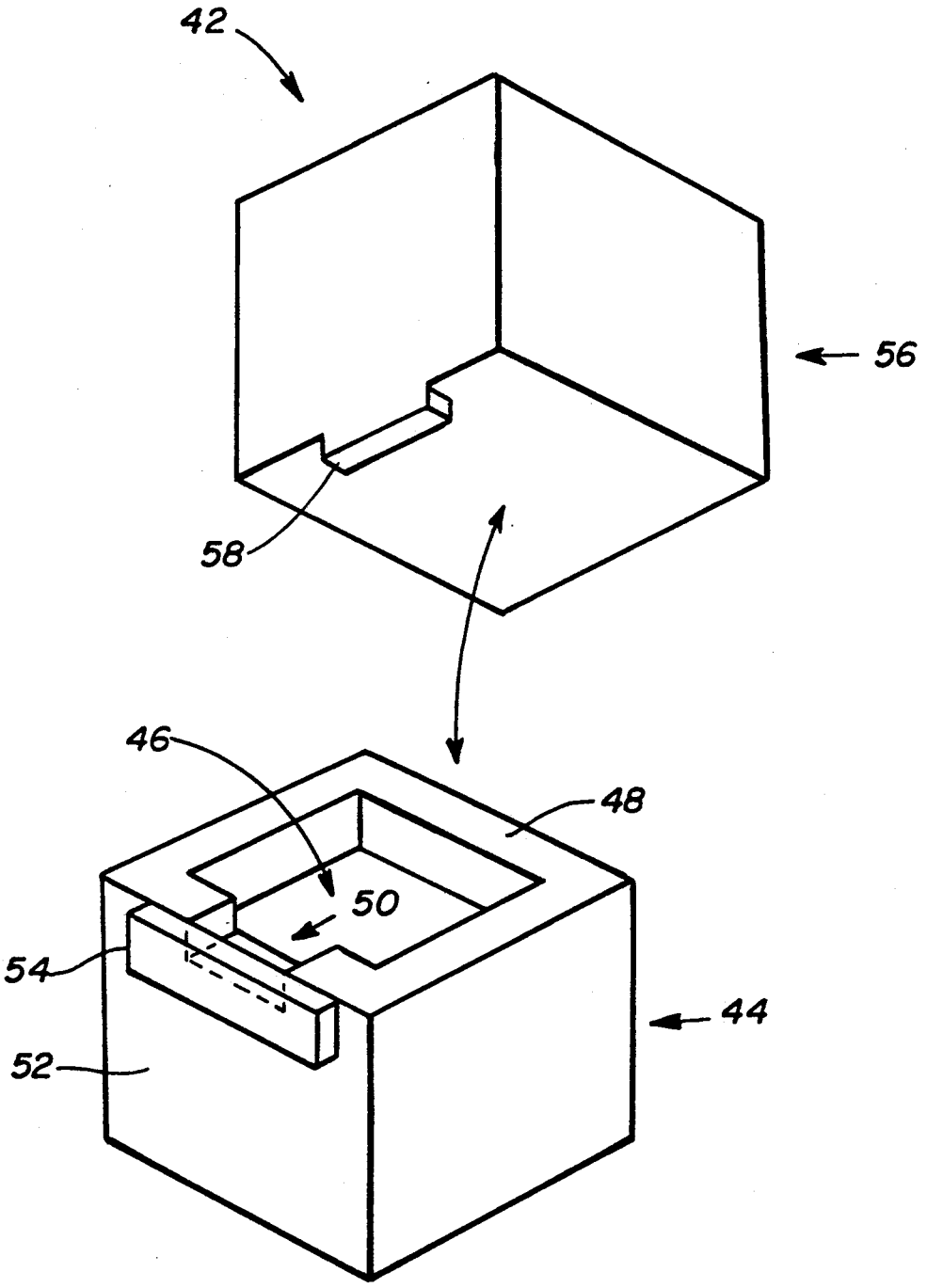
FIG. 3 illustrates a first mold that can be used to form a premold in accordance with the present invention.

Referring to FIG. 3, the first mold 42 may comprise a bottom block 44 having an indentation 46 on a top surface 48 for receiving one of the housings 12 connected to conductors 14 as described above. In this embodiment, the depth of the indentation 46 is the same as the thickness of the connector housing 12 to be used. A portion 50 of the indentation 46 extends to a side 52 of the bottom block 44. The indentation portion 50 is raised with respect to the remainder of the indentation 46, i.e., has a shorter depth than the remainder of the indentation 46. A resiliently deformable wall 54 is attached to the side 52 of the bottom block 44 blocking the indentation portion 50. The deformable wall 54 can be made of rubber or comparable synthetic materials. The first mold 42 may further comprise a top block 56 having a projection 58 for inserting into the raised indentation portion 50 of the bottom block 44. The projection 58 is shorter than the depth of the raised indentation portion 50.

The premold 16 is formed by placing one of the housings 12 connected to the conductors 14 as described above in the indentation 46 of the first mold 42 with the conductors 14 extending through the raised indentation portion 50 and over the flexible wall 54. Premold encapsulant material in a semi fluid form, like that of relatively thick glue, is applied to the conductors 14 in the raised indentation portion 50. Preferably, this is accomplished with an encapsulant that is solid at room temperature and ambient pressure. In which case, the encapsulant material may be heated until it is in fluid or semi fluid form before it is applied. The projection 58 of the top block 56 is inserted into the raised indentation portion 50 pressing the conductors 14 into and, as a result, downwardly deforming the resilient wall 54, squeezing the encapsulant around and between the conductors 14, and conforming the encapsulant into a desired repeatable shape for the premold 16. After the encapsulant is cured or solidified, the first mold 42 is removed from the apparatus.

Of course, the first mold 42 can have other shapes. For instance, the depth of the indentation 46' can be less than the thickness of the connector housing 12. Then the top block 56' would not need a projection 58, just a flat surface for laying on top of its raised indentation portion 50'. With this configuration, the entire cross section of the raised indentation portion 50' would define the sides of the premold 16.

Then the overmold 18 is formed by conventional injection molding in a second mold (not depicted) at a second temperature and a second pressure connecting the premold 16 to the housing 12. The premold 16 is positioned between edges of the second mold during formation of the overmold 18 such that the premold 16 partially extends out of the second overmold end 40. The premold 16 functions as a seal-off or seal eliminating leaking or wicking out of the injected material (forming the overmold 18) near the connectors 14 regardless of their proximity to one another and their cross sectional shapes, sizes or types of construction. The second temperature and the second pressure are elevated with respect to room temperature and ambient pressure and substantially greater than the first temperature and first pressure. The second mold can be made to form the overmold 18 on the premold 16 having a standard repeatable shape regardless of the number, size and configuration of the conductors 14.

The importance of this invention is that many types and sizes of conductors 14 in any registration can be terminated to a connector and be successfully over-molded with no expensive change over tooling necessary for the strain relief overmold.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A cable assembly for interconnecting electrical circuits comprising:

a connector housing having a first end and a plurality of passages extending into the first end;

a plurality of conductors, each of the conductors extending into a different one of the passages through the first housing end, at least a first one of the conductors having a portion with a cross sectional shape, size or type of construction, different than the other conductors;

a premold encapsulating the conductors including the portion near but spaced from the first end of the housing; and an overmold connecting the premold to the housing, whereby the premold and the overmold function as a seal and strain relief for anchoring and preventing bending and twisting of the conductors with respect to the housing.

2. A cable assembly for interconnecting electrical circuits comprising:

a connector housing having a first end and a plurality of passages extending into the first end;

a plurality of conductors having various cross sectional shapes, sizes or types of construction, each of the conductors extending into a different one of the passages through the first housing end, wherein there are more of the passages than the conductors;

a premold encapsulating the conductors near the housing; and an overmold connecting the premold to the housing, whereby the premold and the overmold function as a seal and strain relief for anchoring and preventing bending and twisting of the conductors with respect to the housing.

3. The cable assembly of claim 1, wherein the premold comprises a block having four generally rectangular planar sides and two ends, the conductors extending through the premold ends.

4. The cable assembly of claim 1, wherein the overmold encapsulates a portion of the premold and the conductors between the housing and the premold such that a first premold end extends out of the overmold.

5. The cable assembly of claim 1, wherein the housing includes four generally rectangular planar sides, the first end and a second end, the ends generally rectangular and planar, the passages arranged in two generally parallel rows and extending from the first housing end to the second housing end.

6. The cable assembly of claim 5, wherein the overmold comprises a block having four generally rectangular planar sides, a first end and a second end, the first overmold end being connected to the first housing end, the premold partially extending out of the second overmold end.

7. A method for making a strain relief for a cable assembly comprising a connector housing, the housing having a first end and a plurality of passages, and a plurality of conductors having various cross sectional shapes, sizes or types of construction, each of the conductors extending into a different one of the passages through the first housing end, comprising the steps of:

forming a premold in a first mold at a first temperature and a first pressure encapsulating the conductors near but spaced from the housing; and forming by injection molding an overmold in a second mold at a second temperature and a second pressure connecting the premold to the housing wherein the second temperature and the second pressure are greater than the first temperature and first pressure, whereby the premold and the overmold function as a seal and strain relief for anchoring and preventing bending and twisting of the conductors with respect to the housing.

8. The method of claim 7, wherein the second forming step further comprises encapsulating a portion of the premold and the conductors between the housing and the premold such that a first premold end extends out of the overmold.

9. The method of claim 7, wherein the first temperature is elevated from room temperature and the first pressure is ambient pressure.

* * * * *